US005454470A

United States Patent [19]

Bricker

[11] Patent Number: 5,454,470

[45] Date of Patent: Oct. 3, 1995

[54] NESTING, SPILL-RESISTANT CONTAINER

[76] Inventor: Steven J. Bricker, 1292 Rambler Rd., DeWitt, Mich. 48820

[21] Appl. No.: 429,033

[22] Filed: Apr. 26, 1995

[51] Int. Cl.[6] ..... B65D 21/02

[52] U.S. Cl. ..... 206/519; 220/710.5; 220/756; 220/771

[58] Field of Search ..... 206/519, 518, 206/520; 220/710.5, 756, 771

[56] References Cited

U.S. PATENT DOCUMENTS

D. 333,067 2/1993 Feltman, III ..... D7/536

3,648,888 3/1972 Cheladze ..... 206/519

4,828,112 5/1989 Vollrath et al. ..... 206/519

5,375,719 12/1994 Mittmann et al. ..... 206/519

*Primary Examiner*—Joseph M. Moy

[57] ABSTRACT

A nesting, spill-resistant container consisting of an open, conical central container flaring outwardly, upwardly, the base of which is surrounded by a reverse flaring concentric open ring. At one section, a connection between the central container and the external base ring is made by an extension of the ring's wall up to and joining with the top of the central container.

2 Claims, 1 Drawing Sheet

NESTING, SPILL-RESISTANT CONTAINER

BACKGROUND OF THE INVENTION

There are several situations in which the use of spill-resistant containers for fluids is desirable. One situation is a drinking cup for children. At present, there are a wide variety of spill-resistant or spill-proof drinking containers available on the market. Bottles and cups with attaching lids, both of which compel the user to suck the fluid out of the container and travel mugs, which either have a valved lid or simply a larger diameter base than top opening, all work well for their intended particular market segment. However, for daily table use by children, where a large fraction of spills occur, each of these containers has some type of deficiency. A lidded cup is naturally a bit less convenient to use than an ordinary open tumbler as the lid must be removed and replaced whenever the cup is filled. Also, the child would not be mastering the skills used to drink from an open cup with a container that requires sucking. The same problem holds true for a cup with a valved lid, which has the additional complication of coordinating valve actuation. A wide-based, open mug (Example see U.S. Pat. No. 333,067) is the simplest solution, but the mug is somewhat more difficult for a child's hand(s) to grasp than an ordinary tumbler. Also, there is the additional inconvenience that, as the mug will not nest, multiple containers consume large amounts of storage space.

Another situation is where spills, though less likely, have even more undesirable consequences. Laboratory chemical containers such as beakers, graduated cylinders, etc., which have been designed to nest to conserve storage space, suffer from the same stability concerns as drinking tumblers. However, spillage of chemicals, though infrequent, often is dangerous and/or creates a number of cleanup problems.

SUMMARY OF THE INVENTION

The primary object of the present invention is to provide a container with the ease of use and storage embodied in an ordinary nestable tumbler coupled with the improved stability and spill resistance of a large-based travel mug. Therefore, this invention consists of an open, conical central container flaring outwardly, upwardly, the base of which is surrounded by a reverse flaring concentric open ring. At one section, a connection between the central container and the external base ring is made by an extension of the ring's wall up to and joining with the top of the central container.

DETAILED DESCRIPTION OF THE PREFERRED EMBODIMENT

Figure 1:
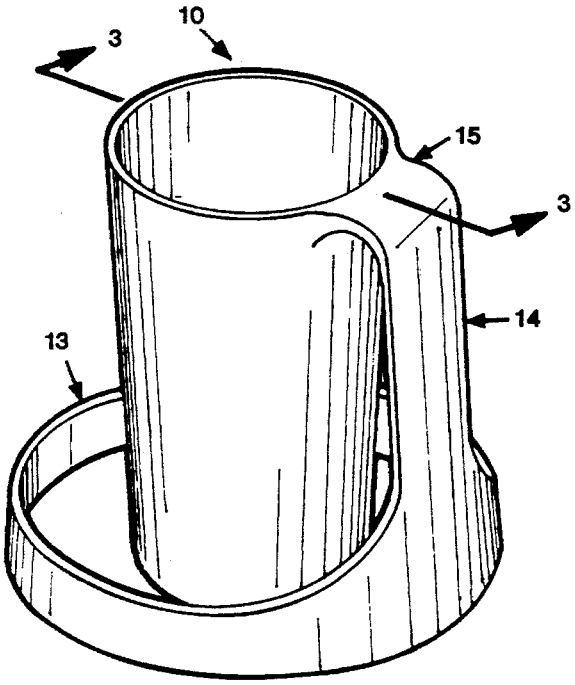
FIG. 1 is a perspective view of the nesting, spill-resistant container of this present invention.
Figure 2:
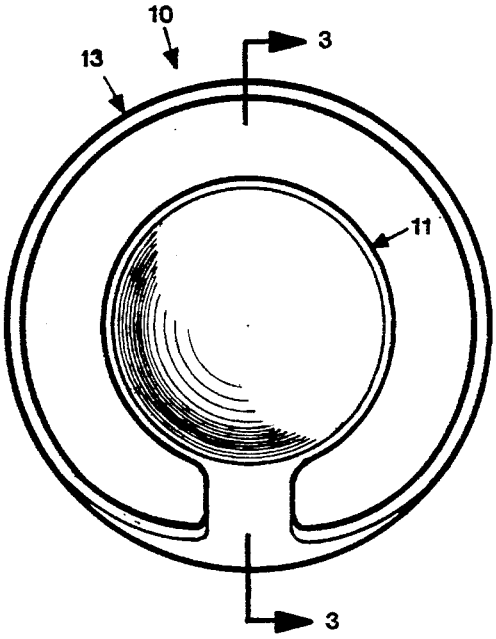
FIG. 2 is a plan view thereof.
Figure 3:
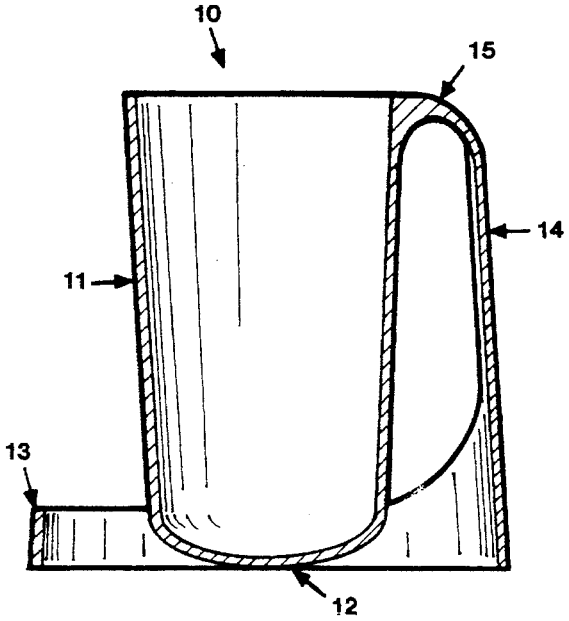
FIG. 3 is a cross-sectional view taken along line 3—3 of FIG. 2 thereof.
Figure 4:
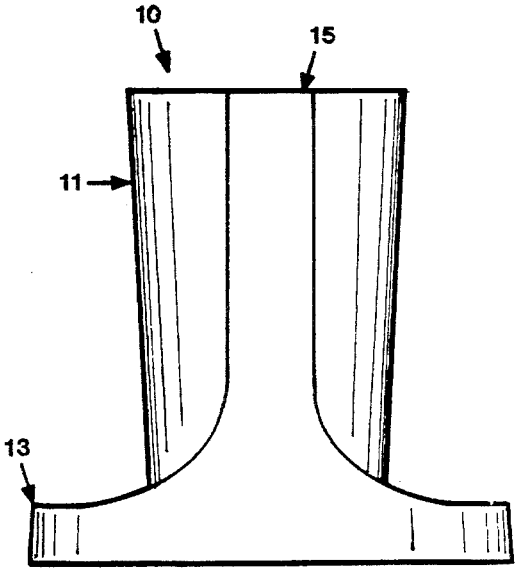
FIG. 4 is a right-side elevational view thereof.

A nesting, spill-resistant container according to the present invention is indicated by reference character 10 in FIG. 1. As with conventional nesting tumblers, the side wall 11 is conical, flaring upwardly, outwardly. As the container 10 relies on the open base ring 13 for stability. The container base 12 is indicated as taking a rounded form, so as to minimize its frictional contact with the surface on which the container is setting. Also, this form would allow easy washing of the container's interior. However, other base forms, which still permit nesting, would not depart from the spirit of this invention.

The base ring 13 is concentric with the side wall 11 and is conical, flaring downwardly, outwardly. The maximum internal diameter of this ring should be at least forty percent greater than the opening diameter of the top of this container. The connection between base ring 13 and the container side wall 11 is accomplished through an upward extension of a section of the cone of the base ring 13, grip 14. The width of grip 14 is such that it can be comfortably grasped in the manner of a handle, if desired, although the container 10 is intended to be grasped about side wall 11 as one would use a conventional tumbler. The space between side wall 11 and grip 14 should be at least 0.75 inches at the narrowest point to ease grasping in this manner and also to facilitate cleaning in this area. The connection point 15 between grip 14 and side wall 11 should be strong enough to ensure that the container 10 does not noticeably deform when filled with water and lifted by grip 14.

This container 10 is intended to be fabricated as a one-piece injection-molded plastic unit though, if desired, can be fabricated of multiple pieces and assembled to form a one-piece unit, either of which is intended for rugged, daily use. Fabrication from other materials, such as glass, ceramic, or metal is also anticipated. This container may also be made of thin thermoformed plastic, with ribbing at connection point 15 so as to be marketed as a disposable plastic cup.

The formation of a pour spout into some portion of the top rim of side wall 11, extending downward and outward no further than would inhibit nesting, together with the addition of volume indicating graduations on side wall 11 will permit use of this invention as a nesting, spill-resistant laboratory chemical container such as a spill-resistant graduated cylinder or a spill-resistant beaker.

I claim:

1. A nesting, spill-resistant container, said container comprising:

An open central container having a base and conical side wall, flaring upwardly, outwardly, surrounded concentrically by a conical ring, the sides of which flare downwardly, outwardly, the bottom of said ring being at the same level as the bottom of said central container and the height of said ring being low enough to permit unimpeded grasping of the outside of said central container with the exception of one portion of said ring which extends upward to a point higher than the point on said central container where the top edge of an identical container would stop when the two containers are nested, whereupon this upwardly extended portion of said concentric conical ring extends inwardly to connect with said side wall of said central container.

2. A nesting, spill-resistant container as set forth in claim 1, wherein a portion of the top edge of said side wall is formed into a pour spout, this formation extending downward and outward no further than would inhibit nesting of identical containers and the inclusion of volume indicating graduations upon said side wall of said container.

* * * * *